United States Patent [19]

Patterson

[11] Patent Number: 4,741,301

[45] Date of Patent: May 3, 1988

[54] ENGINE VALVE TRAIN WITH INNER AND OUTER CAM FOLLOWERS

[75] Inventor: Charles E. Patterson, Mount Clemens, Mich.

[73] Assignee: General Motors Corporation, Detroit, Mich.

[21] Appl. No.: 935,759

[22] Filed: Nov. 28, 1986

[51] Int. Cl.[4] ..... F01L 1/26

[52] U.S. Cl. ..... 123/90.22; 123/90.43; 123/90.44; 123/90.46; 123/90.4

[58] Field of Search ..... 123/90.22, 90.23, 90.27, 123/90.39, 90.41, 90.43, 90.6, 90.48, 432, 315, 90.4, 90.44, 90.45, 90.46, 308

[56] References Cited

U.S. PATENT DOCUMENTS

| | | | |
|---|---|---|---|
| 3,137,689 | 6/1964 | Sampietro | 123/90.43 |
| 3,533,382 | 10/1970 | Bonello | 123/90.48 |
| 3,882,832 | 5/1975 | Ohsaki et al. | 123/90.6 |
| 3,882,834 | 5/1975 | Goloff et al. | 123/90.39 |
| 4,104,096 | 8/1978 | Hosono et al. | 123/90.43 |
| 4,671,222 | 6/1987 | Gallot et al. | 123/90.27 |
| 4,674,453 | 6/1987 | Dove, Jr. | 123/90.39 |

*Primary Examiner*—Ira S. Lazarus
*Assistant Examiner*—M. Macy
*Attorney, Agent, or Firm*—Arthur N. Krein

[57] ABSTRACT

A valve train for an internal combustion engine of the type having two inlet valves and two exhaust valves per cylinder, with these valves being in a splayed configuration, has a pivotal rocker arm for each of these valves, with these rocker arm sets for the inlet valves and exhaust valves being actuated from a single camshaft having inlet and exhaust cams thereon by the use of cylindrical inner and outer lifter concentrically positioned and located such that their axis of reciprocation is at the intersection of imaginary planes extending through the reciprocating axes of the valves.

5 Claims, 3 Drawing Sheets

ENGINE VALVE TRAIN WITH INNER AND OUTER CAM FOLLOWERS

FIELD OF THE INVENTION

This invention relates to an engine valve train for an internal combustion engine and, in particular, to an engine valve train having inner and outer concentrically mounted cam followers to effect operation of the multi inlet and exhaust valves per cylinder of an engine.

DESCRIPTION OF THE PRIOR ART

The desirability of obtaining a true hemispherical combustion chamber in a multi inlet and exhaust valve per cylinder engine has been recognized. It has also been recognized that in order to obtain this result the valves are required to be arranged in a splayed configuration, that is, the valves must be inclined so that their axes intersect. Of course such a valve arrangement complicates the operation of the valves with any known conventional overhead cam structure because the associate valve stems are out of the plane of rotation of any conventional associate cam lobes.

SUMMARY OF THE INVENTION

The present invention relates to a valve train for use in an engine of the type having two inlet valves and two exhaust valves per cylinder with these valves alternately arranged in a splayed configuration, the valves being operated by the use of two translating cam followers or lifters operating along an axis or line formed by the intersection of the planes containing the valve stems of opposing valves such that both inlet and exhaust lifters share the same line of action, the two lifters being positioned concentrically so as to operate from a common camshaft having both intake and exhaust cams thereon for each cylinder of the engine.

It is therefore a primary object of this invention to provide an improved valve train for use in an engine of the type having four valves per cylinder wherein two inlet valves are alternately positioned relative to two exhaust valves, with these valves being inclined relative to each other so that their reciprocating axes intersect, with these valves being operated by a pair of concentrically mounted lifters operated by a common camshaft.

Another object of this invention is to provide an improved valve train for an internal combustion engine of the type having two intake and two exhaust valves per cylinder whereby the inlet valves are positioned between the pair of exhaust valves so as to induce greater inlet swirl velocities in the associate combustion chamber for promoting greater combustion efficiency.

For a better understanding of the invention as well as other objects and further features thereof, reference is had to the following detailed description of the invention to be read in connection with the accompanying drawings.

DESCRIPTION OF THE PREFERRED EMBODIMENT

Figure 2:
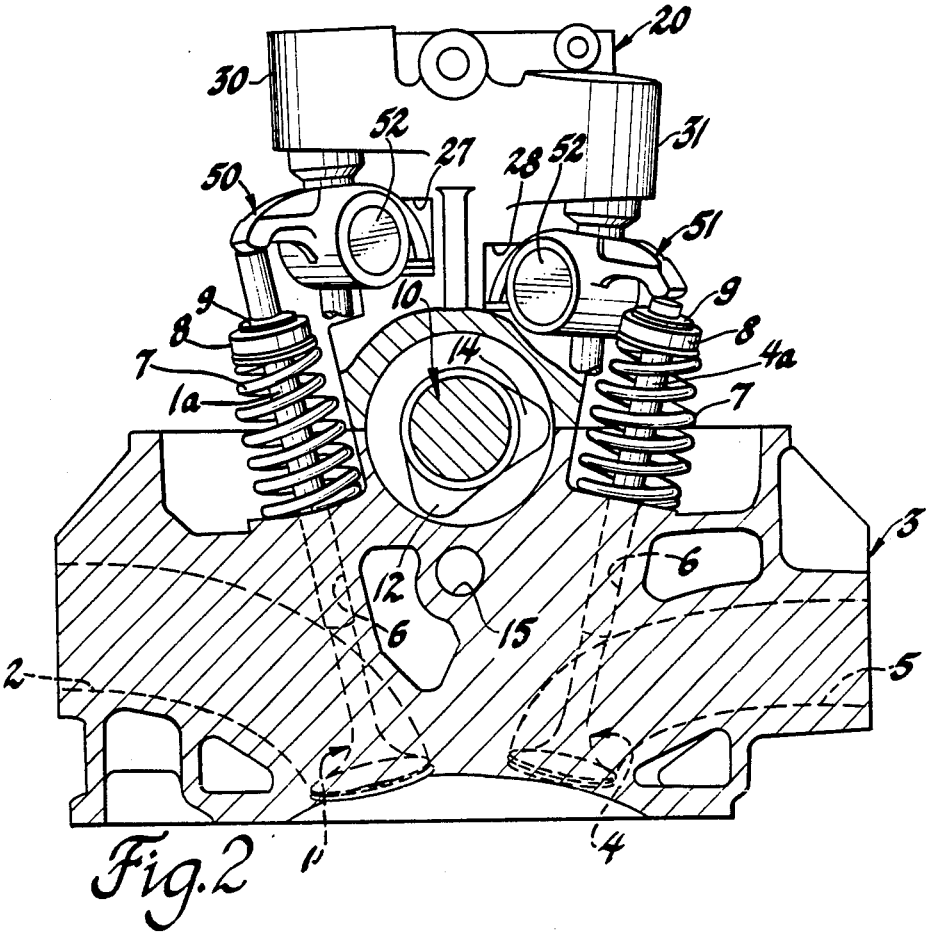
FIG. 2 is a transverse cross-section view of the engine of FIG. 1 showing the cylinder head and upper support structure for the valve train and showing, in part, the splayed arrangement of an intake valve and exhaust valve, with the overhead support structure, rocker arms and valves shown in elevation.
Figure 7:
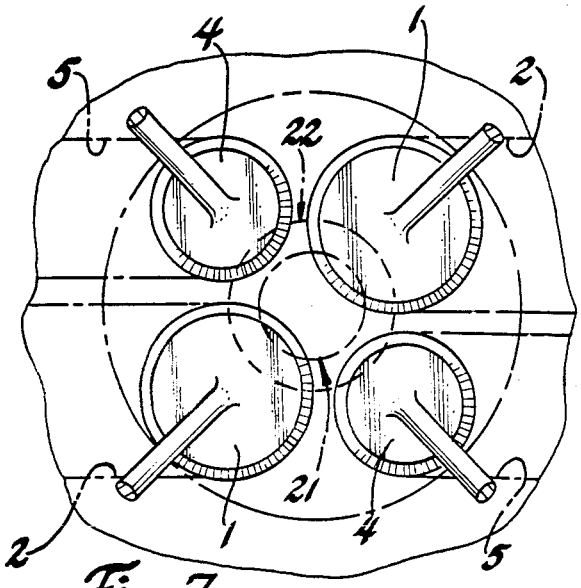

Referring first to FIG. 7 and before describing the engine valve train of the subject invention, it should first be noted that in order to attain a true hemispherical combustion chamber in a multi inlet and exhaust valves per cylinder in an internal combustion engine, the poppet type inlet valves 1 controlling the ingress of fluid into a combustion chamber via inlet passage 2 in the cylinder head 3, see FIG. 2, and the exhaust valves 4 controlling the egress of fluid out through the exhaust passage 5 must be arranged in a splayed configuration as schematically illustrated in this Figure. Also as shown in FIG. 7, the inlet valves 1 are positioned opposite to each other so as to induce greater swirl velocities in the combustion chamber, not shown, to promote greater combustion efficiency. Accordingly, as shown, each inlet valve 1 is positioned between adjacent exhaust valves 4 which are also aligned opposite to each other and, therefore, according to a feature of the subject invention, a pair of concentric valve lifters, to be described in detail hereinafter, for these valves have their axes of reciprocation located at the intersection of planes containing the axes of opposite valve stems as schematically illustrated in FIG. 7.

As shown in FIG. 2, each of the inlet valves 1 and exhaust valves 4 are reciprocably guided by their respective valve stems 1*a* and 4*a* being slidably received in associate valve stem guide bores 6 provided for this purpose in the cylinder head 3, forming part of an engine cylinder block means, as conventional in the art. Also as conventional, each of the inlet valves 1 and exhaust valves 4 are normally biased to their respective closed positions, as shown only in FIG. 2, by a valve return spring 7 which abuts at one end against a surface of the cylinder head 3 and at its opposite end against a spring retainer 8 secured to the associate valve stem by a retainer lock 9, in a manner well known in the art.

Figure 3:
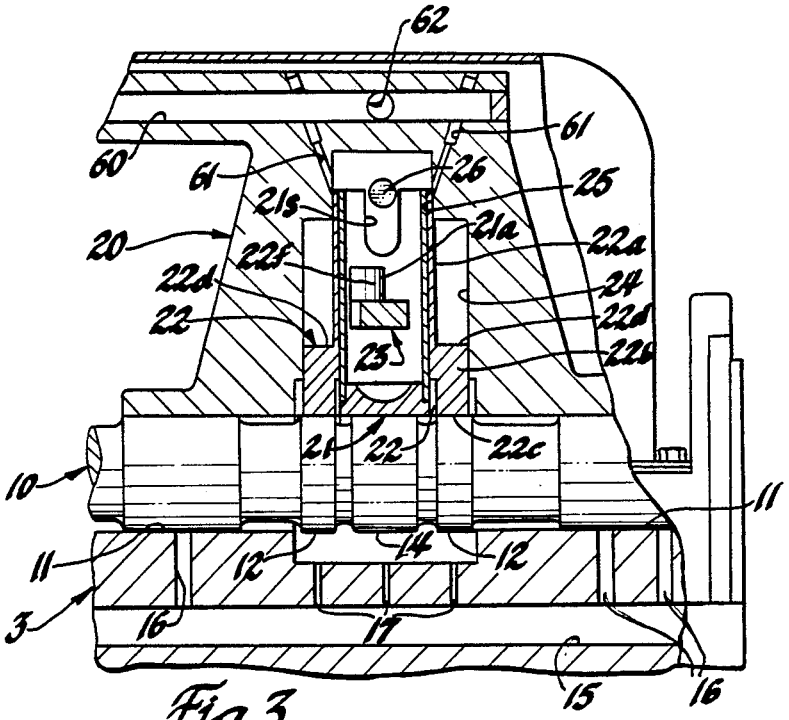
FIG. 3 is a longitudinal cross-sectional view showing a portion of the cylinder head, overhead support, the camshaft, lifters and associate lubricating passages, per se, of the engine of FIG. 1.

As best seen with reference to FIGS. 2–5, an engine driven camshaft 10 is rotatably supported as by split sleeve bearings 11 formed in the mating halves of an upper portion of the cylinder head 3 and an upper support member, generally designated 20, suitably secured to the cylinder head 3. Adjacent each location of a cylinder, not shown, the camshaft 10 is provided, as best seen in FIG. 3, with a pair of axial spaced apart exhaust cam lobes 12 used to effect operation of the exhaust valves 4 and in between the cam lobes 12 there is provided an intake cam lobe 14 used to effect operation of the intake valves 1 all in a manner to be described.

Preferably and as best seen in FIG. 3, a longitudinal extending oil gallery 15 is formed in the cylinder head 3 which is supplied in a conventional manner with pressurized lubricating oil during engine operation to effect lubrication of the bearings 11 and of the cam lobes 12 and 14 by means of riser passages 16 and riser spray passages 17, respectively, that are each in flow communication at their respective lower ends with the oil gallery 15.

Figure 4:
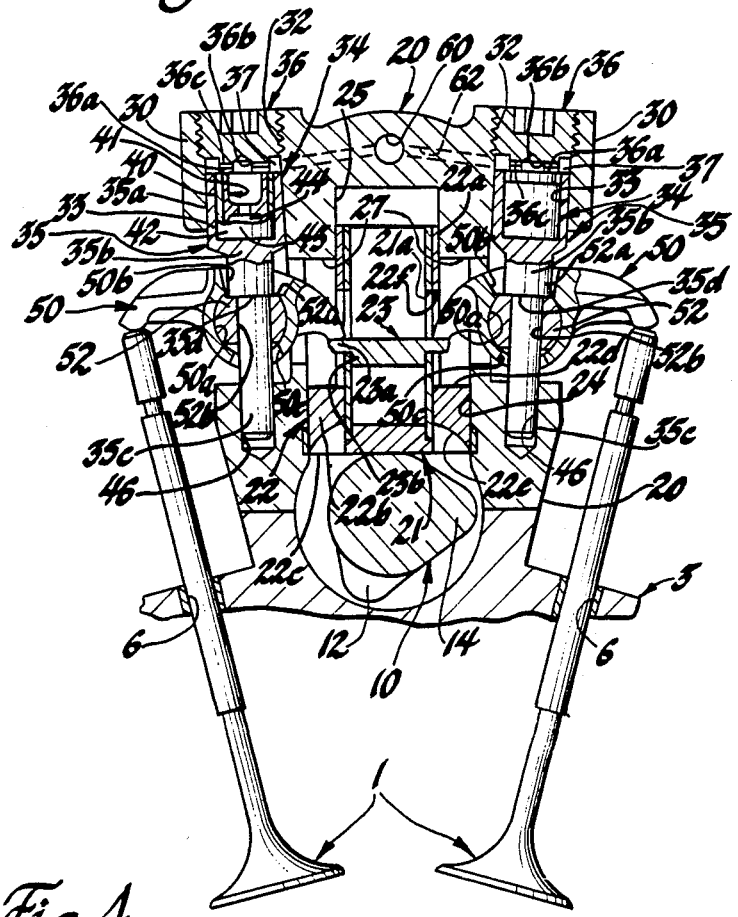
FIG. 4 is a cross-sectional view taken along line 4—4 of FIG. 1 to show the valve train arrangement for the opposed, splayed intake valves.
Figure 5:
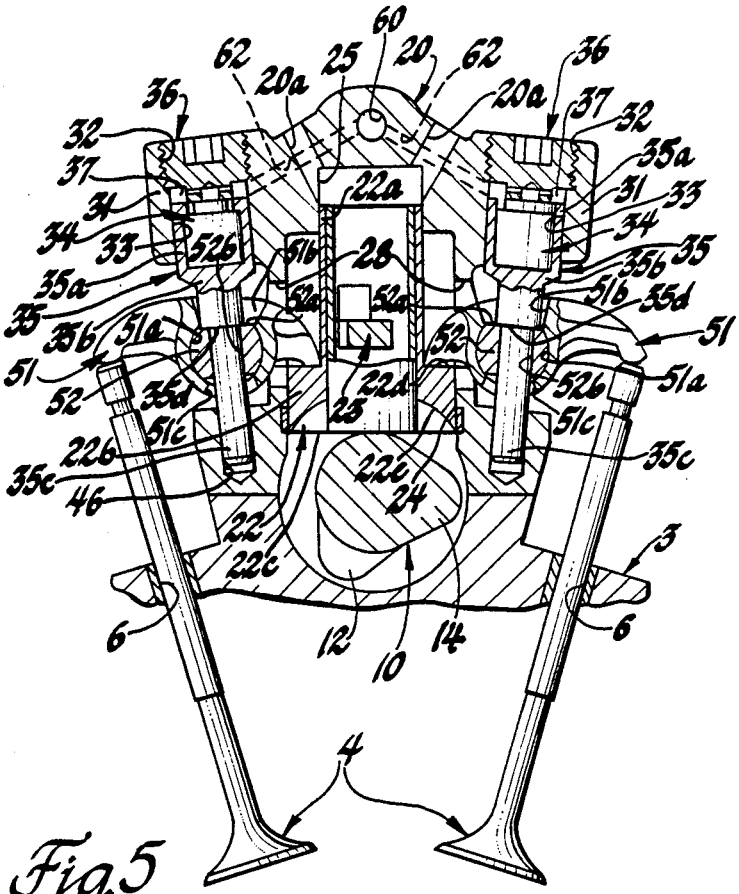
FIG. 5 is a cross-sectional view taken substantially along line 5—5 of FIG. 1 to show the valve train arrangement for the opposed, splayed exhaust valves.

As shown in FIGS. 3–5, the inlet cam lobe 14 is used to effect the operation of a substantially cylindrical inner or inlet lifter 21 and the exhaust cam lobes 12 are used to effect the operation of a substantially cylindrical outer or exhaust lifter 22, these lifters 21 and 22 being positioned concentrically for reciprocating movement along a common central axis located at the intersection of the planes containing the axes of opposite sets of valve stems of the inlet valves 1 and exhaust valves 4, as schematically illustrated in FIG. 7.

Preferably, the exhaust lifter 22 is a two part lifter split along a plane extending through its reciprocating axis, thus defining two semi-cylindrical upper wall portions **22*a*, each having at its lower end a semi-circular radial outward flange 22*b*, the lower surface 22*c* of each, such flange being adapted to ride on an associate exhaust cam lobe 12 while the upper surface 22*d* is adapted to be engaged by the actuator end of an exhaust rocker arm 51 for an associate exhaust valve 4. The purpose for preferably forming the exhaust lifter 22 as two mating pieces is due to the fact that, because of manufacturing tolerances in the mass production of the camshafts 10, the two cam lobes 12 may not be perfectly identical, and thus the two halves of the exhaust lifter 22 are in effect free to move relative to each other, as necessary. In addition, as shown in FIGS. 4 and 5, the flanges 22*b* are preferably provided with arcuate grooves 22*e* so as to prevent contact with the intake cam lobe 14**.

As best seen in FIG. 4, both the inlet lifter 21 and the tubular wall of the exhaust lifter 22 are provided with diametrical opposed, axial extending windows **21*a* and 22*f*, respectively. As illustrated in this Figure, a T-shaped inner lifter key 23 is fixed to the inlet lifter 21 with the top bar 23*a*, of this inner inlet lifter key 23, being of a rectangular configuration and of an extent such that opposed ends thereof extend out through the windows 21*a* and 22*f* whereby they can be engaged by the actuator end of the inlet rocker arms 50 associated with the inlet valves 1. The base 23*b* of this inner inlet lifter key 23 being of circular configuration and of a size to correspond to the internal diameter of the inner inlet lifter 21** so as to be received thereby and retained by the rocker arms.

As best seen in FIGS. 3–5, the upper support member 20 is provided with a stepped bore that extends from adjacent to the axial camshaft bore so as to define a lower lifter guide bore 24 and an upper lifter guide bore 25 to slidably receive the flange **22*b* portions of the exhaust lifter 22 and the upper tubular portion 22*a* thereof, respectively. As best seen in FIG. 5, the upper support member 20 is also provided with at least one passage 20*a*, two such passages 20*a* being shown in this Figure, which are located so as to open at one end through the bore 25** wall and at the opposite end in flow communication with the atmosphere.

In addition, as shown in FIG. 3, the upper tubular portion of the inlet lifter 21 and exhaust lifter 22 are provided with a guide receiving slot, only the guide receiving slot **21*s* in the inner inlet lifter being seen in this Figure, to slidably receive a guide pin 26 suitably fixed to extend radially inward from bore wall 25 so as to prevent rotation of the inlet and exhaust lifters 21 and 22**, respectively.

Figure 1:
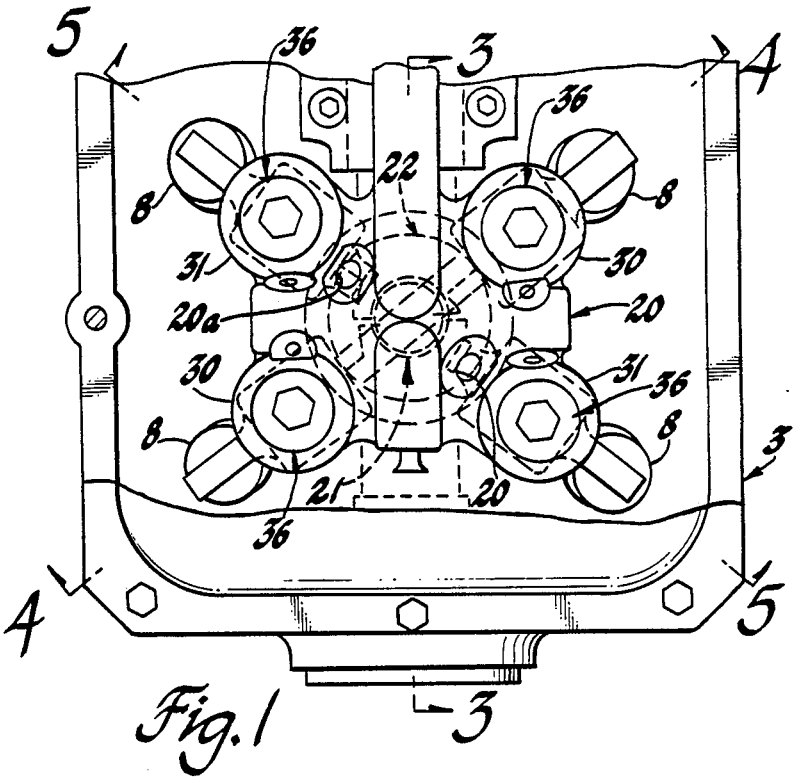
FIG. 1 is a top view of an end portion of an engine having a valve train in accordance with the invention incorporated therein.

Referring now to the upper support member 20, as best seen in FIG. 1, this element at each location of an engine cylinder, not shown, is provided with opposed sets of lash adjuster support arms 30 and 31 that extend radially outward relative to the central axis of the associate cylinder, not shown, the support arms 30 being associated with the intake valves 1 and the support arms 31 being associated with the exhaust valves 4. In addition and as best seen in FIGS. 2, 4 and 5, the upper support member 20 is provided with separate sets of window-like openings 27 and 28 aligned below the support arms 30 and 31, respectively, to loosely receive the actuator ends of inlet and exhaust rocker arms 50 and 51, respectively.

As best seen in FIG. 4, each support arm 30, as well as each support arm 31, is provided with a stepped bore therethrough defining an upper internally threaded wall 32 and a lower rocker pivot support stud guide bore 33 the latter slidably receiving the cup-shaped upper body portion **35*a* of a rocker pivot support stud 35 in which there is operatively positioned a conventional hydraulic lash adjuster, generally designated 34. A stepped closure plug 36 is threadedly received in the internally threaded wall 32 and is provided with a depending boss 36*a*, of a predetermined reduced diameter which forms with the adjacent wall of the guide bore 33 an annulus reservoir or cavity 37 for hydraulic fluid that is supplied in a manner to be described hereinafter. The boss 36*a* is also provided with a blind bore 36*b* extending from its lower free end to communicate with one or more radial passages 36*c* opening into the cavity 37**.

Although any suitable hydraulic lash adjuster 34 may be used, in the construction illustrated, the hydraulic lash adjuster 34 is of the type as disclosed in U.S. Pat. No. 3,509,858 issued May 5, 1970 to Schiebe et al, the disclosure of which is incorporated herein by reference thereto. Thus the hydraulic lash adjuster 34, as shown in FIG. 4, includes a cup-shaped body 40 received in the upper body portion **35*a* and a tubular plunger 41 slidably received in the body 40 so as to define with the closed end of the body a fluid pressure chamber, not shown, with this chamber being supplied with hydraulic fluid from the cavity 37 via a passage means 41*a* in the plunger 41, flow through which is controlled by a one-way valve, not shown, in a manner well known in he art. In addition, a spring, not shown, is operatively positioned in the fluid pressure chamber, not shown, so as to normally bias the plunger 41 outward relative to the body 40 so that the latter abuts against the bottom wall of the blind bore 35*d* in the upper body portion 35*a* of the rocker pivot support stud while the upper end of the plunger 41 abuts against the lower surface of the boss 36*a* of closure plug 36**.

Referring again to the rocker pivot support stud 35, it also includes a stepped shank depending from the upper body portion **35*a* that includes an upper portion 35*b* and a reduced diameter lower guide portion 35*c* that is adapted to be slidably received in a blind guide bore 46 provided for this purpose in the upper support 20, with these portions 35*b* and 35*c* of the rocker pivot support stud 35 being interconnected by a flat shoulder 35*d***.

Figure 6:
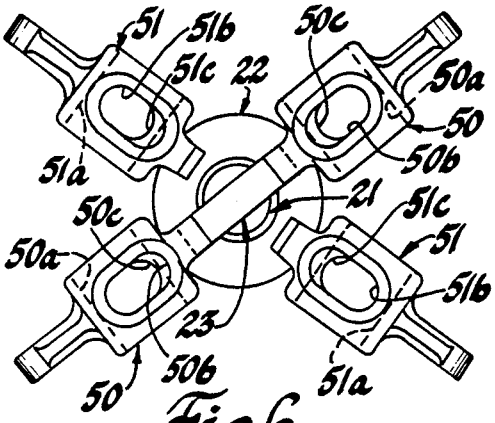
FIG. 6 is a top view of the rocker arms and lifters, per se, of the engine valve train of FIG. 1; and, FIG. 7 is a top, schematic view of the splayed sets of intake and exhaust valves, and associate intake and exhaust valve lifters.

As illustrated, each of the inlet rocker arms 50, intermediate their ends, is provided with a transverse bore 50*a* to receive a rocker shaft 52 by which it is pivotably supported and with upper and lower longitudinally extending slots 50*b* and 50*c*, respectively, as best seen in FIGS. 4 and 6. In addition, each rocker shaft 52 is provided with a flat shoulder 52*a* on at least its upper surface, with respect to FIG. 4, and with a through bore 52*b* formed at right angles to the axis thereof, which bore 52*b* is of a size to slidably receive the lower guide portion 35*a* of the rocker pivot support stud 35.

With this arrangement, the upper portion 35*b* of the stem of the rocker pivot support stud 35 is operative to extend through the upper slot 50*b* in the inlet rocker arm 50 so the shoulder 35*d* abuts against the flat shoulder 52*a* of the rocker shaft 52, with the lower guide portion 35*c* then extending through the bore 52*b* in the rocker shaft 52, lower slot 50*c* of the inlet rocker arm 50 and into the associate guide bore 46 in the upper support 20, with the hydraulic lash adjuster 34 thus being operative to insure proper lash adjustment to maintain the actuator end of the rocker arm 50 in operative contact with the lifter key 23 of the inlet lifter 21 and the opposite end of the rocker arm 50 to contact with the upper free stem end of an associate inlet valve 1.

As best seen in FIGS. 5 and 6, each exhaust rocker arm 51, intermediate its ends, is also provided with a transverse bore 51*a* to receive an associate rocker shaft 52, and with upper and lower longitudinally extending slots 51*b* and 51*c*, respectively, whereby each exhaust rocker arm 51 is pivotably supported in the same manner as described with reference to the inlet rocker arms 50. Accordingly, it is not deemed necessary to again describe the associate plugs 36, rocker pivot support studs 35, hydraulic lash adjusters 34 and rocker stub shafts 52 in detail again except to note that with respect to the exhaust rocker arms 51, the above referred to elements are used to locate the actuator end of an associate exhaust rocker arm 51 in operative engagement with the upper surface 22*d* of the outer exhaust lifter 22 and its opposite end in operative engagement with the free stem end of an associate exhaust valve 4.

As best seen in FIG. 3, the upper support member 20 is also provided with a longitudinal extending oil gallery 60, supplied in a conventional manner with lubricating oil during engine operation. At each of the inner and outer lifter 21 and 22, respectively, locations these lifters are lubricated by means of orifice passages 61 each of which is in flow communication at one end with the oil gallery 60 and at its opposite end opens through the wall defined by the upper guide bore 25. In addition, oil supply passages 62 extend from the oil gallery 60 through the support arms 30 and 31, as shown in FIGS. 4 and 5 to supply hydraulic fluid, i.e., lubricating oil to the reservoirs or cavities 37 used to supply hydraulic fluid to the hydraulic lash adjusters 34.

Accordingly, with the arrangement described and illustrated, sets of alternate, splayed intake and exhaust valves can be actuated by an engine driven camshaft having separate cams used to effect operation of two concentrically mounted cam followers acting on associate rocker arms operatively positioned to actuate the associate intake and exhaust valves, the axis of reciprocation of the cam followers being located on a line formed by the intersection of the imaginary planes containing the axes of the sets of opposite valve stems.

With this arrangement, during rotation of the engine driven camshaft 10, the inlet cam lobe 14 therein will effect reciprocation of inlet lifter 21 whereby causing pivotal movement of the inlet rocker arms 50 so as to move the associate inlet valves 1 through a valve opening and closing cycle and, in the same manner the exhaust cam lobes 12 will effect reciprocation of the exhaust lifter 22 to cause pivotal movement of the exhaust rocker arms 51 to move the associate exhaust valves 4 through a valve opening and closing cycle.

While the invention has been described with reference to the structure disclosed herein, it is not confined to the specific details set forth, since it is apparent that many modifications and changes can be made by those skilled in the art. For example, it is apparent that the inner or inlet lifter 21 would be used as the exhaust lifter with the outer or exhaust lifter 22 then serving as the inlet lifter, with corresponding changes in the use of the associate rocker arms 50 and 51. This application is therefore intended to cover such modifications or changes as may come within the purposes of the improvements or scope of the following claims.

The embodiments of the invention in which an exclusive property or privilege is claimed are defined as follows:

1. A valve train for an internal combustion engine of the type having an engine block means including a cylinder and with a cylinder head defining two inlet ports and two exhaust ports for the cylinder, a valve reciprocably located in each of said inlet ports and said exhaust ports with the two said valves associated with said inlet ports alternating with the two said valves associated with said exhaust ports, with all said valves being arranged in a splayed configuration, said engine block means further including an upper support member fixed to said cylinder head, an engine driven camshaft operatively mounted in said engine block means and having a pair of axially spaced apart exhaust cams thereof and an inlet cam thereon located between said exhaust cams, a plurality of rocker arms each operatively associated at one end thereof with an associate one of said valves, a stepped bore in said cylinder head and upper support means formed at right angles to said cams on said camshaft and above said cams, plural means each defining a rocking support intermediate the ends of an associate one of said valves, and a tubular inner inlet lifter and a tubular outer lifter reciprocably journaled in said stepped bore with said inner lifter engaging said inlet cam and being operative to engage the opposite end of each one of said rocker arm associated with said inlet valves, said outer lifter engaging said exhaust cams and being operative to engage the opposite end of each one of said rocker arms associated with said exhaust valves, the axis of reciprocation of said inner and outer lifters being located on the intersection of two imaginary planes extending through the axis of reciprocation of opposed sets of said valves.

2. A valve train in accordance with claim 1 wherein each of said rocker arms intermediate its ends is provided with a transverse bore and with upper and lower longitudinal slots and, wherein each of said rocker support means includes a rocker shaft operatively positioned in an associate said transverse bore, said rocker shaft having a radial through bore intermediate its ends, a rocker support stud slidably received at opposite ends in said upper support member and in said cylinder head, said rocker support stud having a stepped shank portion extending through an associate said rocker arm and said rocker shaft with a portion of said stepped shank portion abutting against said rocker shaft, and an hydraulic lash adjuster means operatively associated with said upper support member and an end of an associate rocker support stud to effect lash adjustment of the associate rocker arm relative to an associate valve.

3. A valve train for an internal combustion engine of the type having an engine block means including a cylinder and with a cylinder head defining two inlet ports and two exhaust ports for the cylinder, said valve train including a valve reciprocably located in each of said inlet ports and in each of said exhaust ports with the two said valves associated with said inlet ports alternating with the two said valves associated with said exhaust ports, with all said valves being arranged in a splayed configuration, a spring means operatively associated with each of said valves to bias the associated said valve to a valve closed position to its associated said port, said engine block means further including an upper support member fixed to said cylinder head, an engine driven camshaft operatively mounted in said engine block means and having a pair of axially spaced apart exhaust cams thereon and an inlet cam thereon located between said exhaust cams, a plurality of rocker arms each operatively associated at one end thereof with an associate one of said valves, a stepped bore in said cylinder head and upper support member formed at right angles to said cams on said camshaft and above said cams, plural rocker support means each defining a rocker support for an associated rocker arm intermediate the ends of an associate one of said rocker arms, and a tubular inner inlet lifter and a tubular outer lifter concentrically reciprocably journaled in said stepped bore with said inner lifter engaging said inlet cam and being operative to engage the opposite end of each one of said rocker arms associated with said inlet valves, said outer lifter engaging said exhaust cams and being operative to engage the opposite end of each one of said rocker arms associated with said exhaust valves, the axis of reciprocation of said inner and outer lifters being located on the intersection of two imaginary planes extending through the axis of reciprocation of opposed sets of said valves.

4. A valve train in accordance with claim 3 wherein each of said rocker arms intermediate its ends is provided with a transverse bore and with upper and lower longitudinal slots and, wherein each of said rocker support means includes a rocker shaft operatively positioned in an associate said transverse bore, said rocker shaft having a radial through bore intermediate its ends, a rocker support stud slidably received at opposite ends in said upper support member and in said cylinder head, said rocker support stud having a stepped shank portion extending through an associate said rocker arm and said rocker shaft with a portion of said stepped shank portion abutting against said rocker shaft, and an hydraulic lash adjuster means operatively associated with said upper support member and an end of an associate rocker support stud to effect lash adjustment of the associate rocker arm relative to an associate valve.

5. A valve train for an internal combustion engine of the type having an engine block means including a cylinder and with a cylinder head defining a first set of two ports and a second set of two ports for the cylinder, said valve train including a valve reciprocably located in each of said first set of ports and said second set of ports with the two said valves associated with said first set of ports alternating with the two said valves associated with said second set of ports, with all said valves being arranged in a splayed configuration, and normally biased to a valve closed position, said engine block means further including an upper support member fixed to said cylinder head, an engine driven camshaft operatively mounted in said engine block means and having a pair of axially spaced apart first cams thereon and a second cam thereon located between said first cams, a plurality of rocker arms each operatively associated at one end thereof with an associate one of said valves, a stepped bore in said cylinder head and upper support means formed at right angles to said cams on said camshaft and above said cams, plural rocker support means each defining a rocking support intermediate the ends of an associate one of said valves, and a tubular inner inlet lifter and a tubular outer lifter concentrically located and reciprocably journaled in said stepped bore with said inner lifter engaging said second cam and being operative to engage the opposite end of each one of said rocker arm associated with said first set of valves, said outer lifter engaging said second cams and being operative to engage the opposite end of each one of said rocker arms associated with said second set of valves, the axis of reciprocation of said inner and outer lifters being located on the intersection of two imaginary planes extending through the axis of reciprocation of opposed sets of said valves.

* * * * *